US006333299B1

(12) United States Patent
Pace et al.

(10) Patent No.: US 6,333,299 B1
(45) Date of Patent: Dec. 25, 2001

(54) LIQUID ACIDIC LIMESCALE REMOVAL COMPOSITION PACKAGED IN A SPRAY-TYPE DISPENSER

(75) Inventors: Luigi Pace, Sorrento; Barbara Delucca, Bologna, both of (IT)

(73) Assignee: The Procter & Gamble Co., Cincinnati, OH (US)

( * ) Notice: Subject to any disclaimer, the term of this patent is extended or adjusted under 35 U.S.C. 154(b) by 0 days.

(21) Appl. No.: 09/530,496

(22) PCT Filed: Nov. 2, 1998

(86) PCT No.: PCT/US98/23377

§ 371 Date: Apr. 28, 2000

§ 102(e) Date: Apr. 28, 2000

(87) PCT Pub. No.: WO99/23194

PCT Pub. Date: May 14, 1999

(30) Foreign Application Priority Data

Oct. 31, 1997 (EP) ..... 97870174

(51) Int. Cl.[7] ..... C11D 7/32; C11D 7/26; C11D 7/40

(52) U.S. Cl. ..... 510/238; 510/191; 510/362; 510/477; 510/488; 510/470; 510/504

(58) Field of Search ..... 510/191, 238, 510/362, 477, 488, 470, 504

(56) References Cited

U.S. PATENT DOCUMENTS

| | | | | |
|---|---|---|---|---|
| 5,677,271 | * | 10/1997 | Bianchetti et al. | 510/253 |
| 5,686,399 | * | 11/1997 | Bianchetti et al. | 510/191 |
| 5,733,859 | * | 3/1998 | Carrie et al. | 510/362 |
| 5,911,909 | * | 6/1999 | Coyle-Rees | 252/187.25 |
| 5,981,449 | * | 11/1999 | Rapisarda et al. | 510/108 |
| 6,001,792 | * | 12/1999 | Vos | 510/238 |
| 6,127,330 | * | 10/2000 | Bonett | 510/370 |
| 6,239,092 | * | 5/2001 | Papasso et al. | 510/238 |
| 6,248,705 | * | 6/2001 | Cardola et al. | 510/191.1 |
| 6,265,366 | * | 7/2001 | Bonett | 510/238 |

FOREIGN PATENT DOCUMENTS

| | | | |
|---|---|---|---|
| 43 43 728 A1 | 12/1993 | (DE) | C09K/21/00 |
| 0 013 585 | 7/1980 | (EP) | C11D/3/37 |
| 0 091 194 | 10/1983 | (EP) | C23G/1/02 |
| 0 666 305 | 8/1995 | (EP) | C11D/3/20 |
| WO 97/25401 | 7/1997 | (WO) | C11D/3/34 |

* cited by examiner

*Primary Examiner*—Gregory Delcotto
(74) *Attorney, Agent, or Firm*—C. Brant Cook; Kim W. Zerby; Steven W. Miller

(57) ABSTRACT

The present invention relates to liquid acidic compositions suitable for removing limescale-containing stains from a hard-surface, comprising an acid, from 0.001% to 20% by weight of the total composition of a polysaccharide polymer and from 0.001% to 20% by weight of the total composition of a vinylpyrrolidone homopolymer or copolymer, said composition being packaged in a spray type-dispenser. Such a composition provides improved shine to the surface treated while exhibiting effective limescale removal performance. The use of a polysaccharide polymer and a vinylpyrrolidone homopolymer or copolymer, in a liquid acidic composition being packaged in a spray-type dispenser, to treat a hard-surface, reduces or even prevents the formation of water-marks and even limescale deposits on said hard-surface after said hard-surface has first been treated with said composition and subsequently comes in contact with water. Also the use of a polysaccharide polymer and a vinylpyrrolidone homopolymer or copolymer, in a liquid acidic composition being packaged in a spray-type dispenser, to treat a hard-surface delivers shine/long lasting shine to the surface.

20 Claims, No Drawings

LIQUID ACIDIC LIMESCALE REMOVAL COMPOSITION PACKAGED IN A SPRAY-TYPE DISPENSER

TECHNICAL FIELD OF THE INVENTION

The present invention relates to liquid acidic limescale removal compositions packaged in a spray-type dispenser.

BACKGROUND OF THE INVENTION

Tap water contains a certain amount of solubilized ions which upon water evaporation eventually deposit as salts such as calcium carbonate on hard-surfaces which are often in contact with water, resulting in an anaesthetic aspect of the surfaces. This limescale formation and deposition phenomenon is even more acute in places where water is particularly hard.

It is well-known in the art that limescale deposits can be chemically removed with acidic solutions, and a great variety of acidic limescale removal compositions have been described for this purpose.

It is also desirable that such liquid acidic compositions should have, in addition to the ability to effectively remove limescale deposits present on a surface, the ability to provide good shine to the surfaces treated. However, surface shine is often compromised because, when water comes in contact with hard-surfaces it has the tendency to form droplets on the surface rather than forming a thin film uniformly spread over the surface or to run off the surface. This results, as water evaporates, in precipitation of poorly water soluble inorganic salts such as calcium/magnesium carbonate and/or phosphate salts with consequent formation of watermarks on the surface and, eventually limescale deposits, resulting in an anaesthetic aspect of the surface.

It is thus an object of the present invention to reduce the formation of watermarks and/or limescale deposits on a hard-surface that has been treated with a liquid acidic composition and hence to provide improved shine to this surface. More particularly, it is an object of the present invention to provide liquid acidic compositions delivering improved shine to the surface treated while exhibiting excellent limescale removing performance. It is yet another object of the present invention to provide such liquid acid compositions in a convenient way so as to facilitate any hard-surface descaling operation therewith by the consumer.

The present invention overcomes these problems by formulating liquid acidic compositions comprising an acid, a polysaccharide polymer (0.001%–20%) and a vinylpyrrolidone homopolymer or copolymer (0.001%–20%), said compositions being packaged in a spray type-dispenser. Indeed, it has been found that the addition of a polysaccharide polymer, preferably xanthan gum, together with a vinylpyrrolidone homopolymer or copolymer, in a liquid acidic composition, reduces or even prevents the formation of limescale deposits on a surface having first been treated with such a composition. Also less formation of watermarks are observed on a surface having been first treated with the compositions as described herein and then contacted with water, for example, during a rinse operation, thereby providing improved shine to said surface.

Another advantage of the present invention is that the shine benefit delivered to a hard-surface treated with the compositions of the present invention persists even after several cycles of rinsing, thus providing long lasting protection against formation of watermarks and/or even limescale deposits on the surface, and hence long lasting shiny surfaces. In other words, the house wife will have the advantage to delay the next descaling operation. Advantageously, the shine benefits herein are obtained at very low total levels of both a polysaccharide polymer and a vinylpyrrolidone homopolymer or copolymer, in the acidic compositions of the present invention.

Another advantage of the liquid acidic compositions of the present invention is that the surfaces treated become smoother (this can be perceived by touching said surfaces). This may also contribute to convey to consumer perception of surface perfectly descaled.

Also it has surprisingly been found that the compositions according to the present invention deliver the benefits mentioned herein (e.g., reduction or prevention of the formation of watermarks and/or even limescale deposits, resulting in good shine benefit and even long lasting shine benefit), when used to treat a variety of surfaces including metal surfaces such as aluminium, chromed steel, stainless steel, synthetic materials like vinyl, linoleum, glazed or non-glazed ceramic tiles, and/or enamel surfaces.

In a preferred embodiment of the present invention, the compositions herein comprise maleic acid together with a second acid typically sulfamic acid. These compositions have been found to be particularly safe to various types of hard-surfaces treated therewith as well as milder to the skin.

Another benefit of the present invention is that the compositions herein are easily applied to the surface to treat while using a minimum amount of said composition, as compared to applying a liquid composition by directly pouring it onto the surface to treat, instead of spraying it according to the present invention. Also spraying the composition on the surface to treat allows to treat a larger area with a give amount of product versus pouring the liquid composition on the surface to treat. Furthermore, the risk of spillage as well as the tendency of the liquid compositions to be messy when applied onto the surface is reduced when said application is made by using a spray-type dispenser.

Advantageously, the liquid acidic compositions of the present invention are applied to the surfaces to treat by the means of a spray-type dispenser while being safe both to the user and to the surfaces treated therewith. Indeed, the acidic compositions herein may be sprayed onto the surfaces to treat with minimal inhalation by the user of said acidic compositions and thus by avoiding any potential health issue due to the presence of an acid in said compositions.

BACKGROUND ART

Limescale compositions comprising acids are known in the art. For example EP-A-666 305 discloses acidic limescale removing compositions comprising maleic acid and a second acid like sulphamic acid. However, no liquid acidic compositions as described in the present invention comprising a polysaccharide polymer together with a vinylpyrrolidone homopolymer or copolymer are disclosed therein.

EP-A-467 472 discloses a hard-surface liquid composition with anti-static/anti-soiling cationic quaternized polymers. Cationic quaternized polymethacrylate include beta (trialkyl ammonium) ethylmethacrylates/acrylates. However, no liquid acidic compositions as described in the present invention comprising a polysaccharide polymer together with a vinylpyrrolidone homopolymer or copolymer are disclosed therein.

WO 94/26858 discloses acidic compositions (pH 2–8) comprising a nonionic surfactant and an anionic polymer having an average molecular weight less than 1,000,000 said polymer being free of quaternary nitrogen groups. However, no liquid acidic compositions as described in the present invention comprising a polysaccharide polymer together with a vinylpyrrolidone homopolymer or copolymer are disclosed therein

SUMMARY OF THE INVENTION

The present invention relates to a liquid acidic composition suitable for removing limescale-containing stains from a hard-surface, comprising an acid, from 0.001% to 20% by weight of the total composition of a polysaccharide polymer and from 0.001% to 20% by weight of the total composition of a vinylpyrrolidone homopolymer or copolymer, said composition being packaged in a spray type-dispenser.

The present invention also encompasses a process of treating hard-surfaces wherein an acidic liquid composition according to the present invention is applied onto said surfaces from a spray-type dispenser, then left to act onto said surfaces and then removed by rinsing.

DETAILED DESCRIPTION OF THE INVENTION

The Liquid Acidic Compositions:

The liquid compositions of the present invention are acidic compositions. Accordingly, the compositions of the present invention are typically formulated at a pH below 7, preferably below 5, more preferably below 4, more preferably at a pH between 0 and 3, even more preferably at a pH between 0.1 and 2.5, even more preferably between 0.1 and 2, and most preferably at a pH between 0.3 and 1.5.

The liquid compositions according to the present invention are preferably aqueous compositions. Therefore, they typically comprise from 50% to 98% by weight of the total composition of water, preferably from 60% to 95% and more preferably from 70% to 90%.

The compositions according to the present invention are designed for removing limescale deposits. Thus, they comprise as a first essential ingredient an acid or a mixture thereof. Typically, the acids to be used herein may be any inorganic or organic acid well-known to those skilled in the art, or a mixture thereof. Suitable acids for use herein include maleic acid, citric acid, adipic acid, sulfamic acid, phosphoric acid, nitric acid, malic acid, sulfonic acid, sulphuric acid or their salts or mixtures thereof. Indeed, such acids can be used in their acidic form or in the form of their salts (mono-, di-, tri- salts) and in all their anhydrous and hydrated forms, or mixtures thereof. Such acids may typically be used in the form of their alkali metal salts (e.g. sodium salt, potassium salt, and then like) or their alkali hydrogen acid salts. Said compositions comprise from 0.1% to 70% by weight of the total composition of an acid or a mixture thereof.

Preferred herein the compositions of the present invention comprise at least maleic acid. Accordingly, the compositions according to the present invention comprise from 0.1% to 45% by weight of the total composition of maleic acid, preferably from 1% to 25% and more preferably from 3% to 20%. This percentage is calculated on the basis of the molecular weight of the acid form, but maleic anhydride is equally convenient for use in the compositions according to the present invention. Indeed, maleic anhydride is generally cheaper and it is transformed into the acid form when incorporated in an aqueous medium. In one embodiment of the present invention maleic acid is used alone as the acid of the acidic compositions of the present invention.

In another embodiment of the present invention, a second acid is added on top of said maleic acid. Said second acid is desired to strengthen the limescale removal performance. Preferably the second acids to be used herein which are particularly efficient to remove limescale on many surfaces, have their first pKa not exceeding 5, more preferably not exceeding 3, and most preferably not exceeding 2. According to the present invention said acids can be organic or inorganic acids. Examples of inorganic acids are sulphonic acid derivatives, sulphamic acid (pKa=0.1), hydrochloric acid (pKa<0), nitric acid (pKa<0), phosphoric acid (pKa=2.1) and sulphuric acid (pKa=0.4). An example of organic acid is citric acid (pKa=3.06).

Particularly suitable for use herein is sulphamic acid. Sulphamic acid may be added in the compositions according to the present invention in its acid form or as an alkali metal salts thereof. Thus sulphamic acid may be added for example as sulphamate. Sulphamic acid is for example commercially available under its chemical name from Albright & Wilson or Nissan chemicals. Indeed, it has been found that the addition of sulphamic acid on top of maleic acid in the compositions of the present invention improves the skin mildness of said compositions. Indeed, less skin irritation is perceived by the user when its skin comes into contact with these compositions as compared to the same compositions but without sulphamic acid.

Other suitable second acids are sulphonic acid derivatives including alkyl sulphonic acids and aryl sulphonic acids.

Suitable alkyl sulphonic acids for use herein are C1–C6 linear or branched alkylsulphonic acids or mixtures thereof, such as methanesuiphonic acid (pKa=1.9) commercially available for example from Aldrich, William Blythe & Co. Ltd. or Elf. Atochem.

Suitable aryl sulphonic acids for use herein are according to the formula:

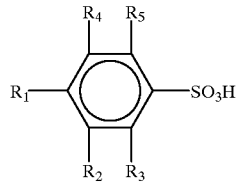

wherein $R_1$, $R_2$, $R_3$, $R_4$ and $R_5$ are each H or $SO_3H$, or linear or branched $C_1$–$C_4$ alkyl chain; or mixtures thereof.

Preferred arylsulphonic acids for use herein are those which comprise no alkyl chain or only one. Indeed, such arylsulphonic acids are particularly effective at removing limescale, which is not the case for their longer alkyl chain homologues. Also, such arylsuiphonic acids are particularly safe to the surface treated therewith. Particularly suitable arylsulphonic acids for use herein are benzene sulphonic acid (pKa=0.7), toluene sulphonic acid and cumene sulphonic acid. Amongst these three, at equal weight %, we have found that the shorter the alkyl chain, down to no chain at all, the better the limescale removing performance.

Preferred acids having a first pKa not exceeding 5 for use herein are sulphamic acid, sulphuric acid, aryl sulphonic acids, alkyl sulphonic acids, citric acid, nitric acid, phosphoric acid, hydrochloric acid or mixtures thereof, more preferred are sulphamic acid, citric acid or mixtures thereof and highly preferred is sulphamic acid.

The compositions of the present invention comprise from 0.1% to 25% by weight of the total composition of a second acid which has a first pKa not exceeding 5, or mixtures thereof, preferably from 0.1% to 20%, more preferably from 0.1% to 10% and most preferably from 0.1% to 7%.

The liquid acidic compositions of the present invention comprise as a second essential ingredient a vinylpyrrolidone homopolymer or copolymer, or a mixture thereof at a level of from 0.001% to 20% by weight of the total composition. Typically, the compositions of the present invention comprise from 0.01% to 5% by weight of the total composition of a vinylpyrrolidone homopolymer or copolymer, or a mixture thereof, more preferably from 0.01% to 3% and most preferably from 0.01% to 1%.

Suitable vinylpyrrolidone homopolymers for use herein are homopolymers of N-vinylpyrrolidone having the following repeating monomer:

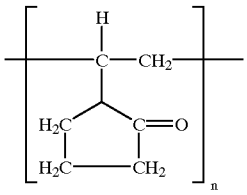

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K60® (average molecular weight of 160,000), and PVP K-90® (average molecular weight of 360,000). Other suitable vinylpyrrolidone homopolymers which are commercially available from BASF Cooperation include Sokalan HP 165®, Sokalan HP 12®, Luviskol K30®, Luviskol K60®, Luviskol K80®, Luviskol K90®; vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well known monomers may be used.

The molecular weight of the copolymer of vinylpyrrolidone is not especially critical so long as the copolymer is water-soluble, has some surface activity and is adsorbed to the hard-surface from the liquid composition comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000 to 1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name Luviskol® series from BASF.

The copolymers of vinylpyrrolidone for use in the compositions of the present invention also include quatemized or unquatemized vinylpyrrolidone/dialkylaminoalkyl acrylate or methacrylate copolymers.

Such vinylpyrrolidoneldialkylaminoalkyl acrylate or methacrylate copolymers (quatemised or unquaternised) suitable to be used in the compositions of the present invention are according to the following formula:

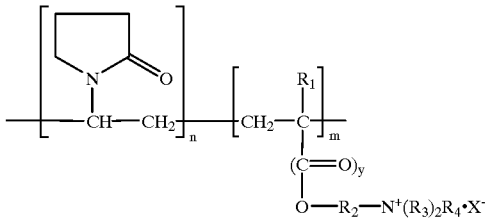

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group of from 1 to 4 carbon atoms, preferably methyl or ethyl, or

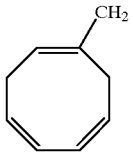

R4 denotes a lower alkyl group of from 1 to 4 carbon atoms, preferably methyl or ethyl; $X^-$ is chosen from the group consisting of Cl, Br, ½$SO_4$, $HSO_4$ and $CH_3SO_3$. The polymers can be prepared by the process described in French Pat. Nos. 2,077,143 and 2,393,573.

The preferred quatemized or unquatemized vinylpyrrolidone/dialkylaminoalkyl acrylate or methacrylate copolymers for use herein have a molecular weight of between 1,000 and 1,000,000, preferably between 10,000 and 500,000 and more preferably between 10,000 and 100,000.

Such vinylpyrrolidoneldialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the tradename Luviquat®.

Preferred second essential ingredient for use herein are the vinylpyrrolidone homopolymers.

The liquid acidic compositions of the present invention comprise as a third essential ingredient a polysaccharide polymer or a mixture thereof at a level of from 0.001% to 20% by weight of the total composition. Typically, the compositions of the present invention comprise from 0.01% to 10% by weight of the total composition of a polysaccharide polymer or a mixture thereof, more preferably from 0.01% to 5% and most preferably from 0.01% to 2%.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like xanthan gum, guar gum, locust bean gum, tragacanth gum or derivatives thereof, or mixtures thereof.

Particularly polysaccharide polymers for use herein are xanthan gum and derivatives thereof. Xanthan gum and derivatives thereof may be commercially available for instance from Kelco under the trade name Keltrol RD®, Kelzan S® or Kelzan T®. Other suitable Xanthan gum are commercially available by Rhone Poulenc under the trade name Rhodopol T® and Rhodigel X747®. Succinoglycan gum for use herein is commercially available by Rhone Poulenc under the trade name Rheozan®.

The polysaccharide polymers herein may act as a thickening agent, accordingly the liquid acidic compositions herein have a viscosity of from 1 cps to 1500 cps, preferably from 20 cps to 800 cps and more preferably from 50 cps to 600 cps, when measured with a Carri-med rheometer CLS 100® at 5 $N/m^2$ at 20° C.

The polysaccharide polymers, preferably xanthan gum or derivatives thereof, and vinylpyrrolidone homopolymer or copolymers, are advantageously physically and chemically stable in the acidic conditions of the compositions herein, this even at very low pH typically below 1.5.

The acidic liquid compositions herein are chemically stable, i.e., there is virtually no chemical changes of the different ingredients due to reaction between different ingredients, and physically stable, i.e., that no phase separation occurs when stored in rapid aging test (RAT) at 50° C. for 10 days.

It has now surprisingly been found that the polysaccharide polymers, preferably xanthan gum or derivatives thereof, and vinylpyrrolidone homopolymers or copolymers described herein, when added into a liquid acidic composition packaged in spray-type dispenser deliver improved shine while not compromising the limescale removal performance of said composition.

The present invention is based on the finding that the polysaccharide polymers and vinylpyrrolidone homopolymers or copolymers present in the compositions of the present invention are able to modify the surface by depositing on the surface itself treated therewith. Although not wishing to be bound by theory, it has been observed that hard surfaces typically found in a household are neither highly hydrophobic nor highly hydrophilic. This means that, when water gets in contact with hard-surfaces, its spreading, which is controlled by the interfacial energy (i.e., solid/liquid surface tension), is very limited. lndeed, it has been observed that the most stable configuration for the water is grouping in spherical droplets rather than forming a thin film uniformly spread over the surface or than running off the surface. Then, as water droplets evaporate, their content of salt progressively becomes higher and higher so that carbonate salts eventually precipitate resulting in watermarks or even limescale deposits. The end result is a reduction of surface shine.

It has now been found that when the polysaccharide polymers as described herein are added into liquid acidic compositions a hydrophilic layer is left on a hard-surface treated therewith, especially low energy surfaces like stainless steel, said hydrophilic layer leaves the water coming in contact with the surface having first been so treated (e.g., water which is used to rinse off the surfaces having been so treated) uniformly spread over the surface ("sheeting effect") instead of forming droplets. It has further been found that when the vinylpyrrolidone homopolymers or copolymers as described herein are added into liquid acidic compositions a hydrophobic layer is left on a hard-surface treated therewith, especially high energy surfaces like ceramic, porcelain, glass and the like, said hydrophobic layer causes the water coming in contact with the surface having first been so treated (e.g., water which is used to rinse off the surfaces having been so treated) to run off the surface instead of forming droplets. Thus by modifying the surface features as indicated, the formation of watermarks and/or limescale deposits upon drying is reduced or even eliminated. In other words, the second and third essential ingredients of the composition of the present invention act together to provide the benefits herein on all type of hard-surfaces from low energy to high energy surfaces.

A definition to what is understood by low energy to high energy surfaces is given in "Surfactant Science and Technology", $2^{nd}$ Edition, by Drew Myers, 1992 VCH Publishers Inc., on pages 268–272.

Furthermore, it has surprisingly been found that the polysaccharide polymers and vinylpyrrolidone homopolymers or copolymers have not only the ability to adhere on a surface treated with the liquid acidic compositions of the present invention comprising the same and being packaged in a spray-type dispenser, but to still remain adhered on the surface even after several cycles of rinsing (e.g., when water comes onto this surface later on for example in a sink during daily household operation), thus providing long lasting protection against formation of watermarks and/or deposition of limescale deposits, hence, long lasting shiny surfaces.

Not to be bound by theory, it is believed that the polysaccharide polymers, and vinylpyrrolidone homopolymers or copolymers also have the ability to form a film on the surface of the user skin thereby further contributing to the skin mildness characteristics delivered due to the presence of sulphamic acid on top of maleic acid otherwise perceived to be more irritant to skin, this in the preferred embodiment of the present invention where indeed sulphamic acid is used on top of maleic acid.

An additional advantage related to the use of the polysaccharide polymers, and vinylpyrrolidone homopolymers or copolymers in the acidic compositions herein, is that as they adhere on hard surface making them more hydrophilic, the surfaces themselves become smoother (this can be perceived by touching said surfaces) and this contribute to convey perception of surface perfectly descaled.

Advantageously, these benefits are obtained at low levels the polysaccharide polymers, preferably xanthan gum or derivatives thereof, and vinylpyrrolidone homopolymers or copolymers described herein, thus it is yet another advantage of the present invention to provide the desired benefits at low cost. Typically, the liquid acidic compositions according to the present invention comprise from 0.002% to 5% by weight of the total composition of a polysaccharide polymer or mixture thereof together with a vinylpyrrolidone homopolymer and/or copolymer, preferably from 0.005% to 2%, more preferably from 0.01% to 2% and most preferably from 0.01% to 1%.

As a further essential feature, the liquid acidic compositions according to the present invention are packaged in a spray-type dispenser.

By "spray dispenser", it is meant any spray dispenser known to those skilled in the art including trigger spray dispensers or pump spray dispensers.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci.

Particularly preferred to be used herein are spray-type dispensers such as T 8500® or T 8900® commercially available from Continental Spray International or T 8100® commercially available from Canyon, Northen Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e. to help the formation of liquid droplets.

Preferred foam trigger-type dispensers for use herein have a cone as impingement zone. The two most important dimensions determining the foam character, size and distribution of pattern are orifice diameter and spinner channel width. The interaction of these two factors also determine amount of flow and velocity of that flow trough the nozzle.

Preferred foam trigger spray type dispenser for use herein is the model known as T8900® commercially available by CSI. This foam spray-type dispenser has a piston pump with an impingement tube that contacts the spray cone causing turbulence and creating foam. Originally, this foam spray dispenser has a orifice diameter of 0.028" (0.028 inches) and a two spinner channels 0.0425" (0.0425 inches) width. Such a commercially available spray may also undergone modifications to improve the spray pattern and reduced the misting effect. For instance preferred configurations are those with smaller spinner channels and larger orifices that will result in a foam spray with less misting. More preferred configuration has a diameter orifice of 0.030" or 0.032" width and spinner channels of 0.0425" or 0.030" width. Most preferred foam spray-type dispenser has 0.030" orifice and 0.0425" spinner channels.

The foam trigger spray dispensers mentioned in the present invention have preferably a bayonet closure instead of a threaded closure, thereby providing a child resistant device. Indeed, the bayonet package (having two or four lugs) allows the spray-type dispenser to be fastened to the bottle in a safer way avoiding ease of opening by children and messiness in use.

An advantage of the present invention is that the acidic liquid compositions of the present invention may be applied uniformly to a relatively large area of a surface to be treated via a spray-type dispenser, thereby ensuring excellent limescale removal performance while being particularly safe to the surface treated and the user.

Another advantage of the present invention is that the liquid acidic compositions of the present invention may be easily dispensed onto the surfaces to treat.

A further advantage according to the present invention is that the surface treatment is carried out in an economical way, i.e. no more product that what is really necessary is used.

Optional Ingredients

The compositions according to the present invention may further comprise a variety of other ingredients including surfactants, colorants, bactericides, thickeners, dyes, chelants, pigments, solvents, stabilizers, perfumes, corrosion inhibitors and the like.

Surfactants

A highly preferred optional ingredient suitable for use in the compositions of the present invention is a surfactant or a mixture thereof. Surfactants are desired herein as they contribute to the cleaning benefits of the limescale removal compositions of the present invention. Indeed, the presence of a surfactant contributes to the greasy soap scum cleaning of the compositions herein. More generally, the presence of a surfactant in the liquid acidic compositions according to the present invention allows to lower the surface tension and to improve the wettability of the surfaces being treated with the liquid acidic compositions of the present invention. The presence of a surfactant or a mixture thereof in the liquid acidic compositions of the present invention helps to solubilize the soils.

Accordingly, the compositions according to the present invention may comprise a surfactant or a mixture thereof. The compositions according to the present invention may comprise up to 40% by weight of the total composition of a surfactant or a mixture thereof, more preferably from 0.05% to 15%, even more preferably from 0.1% to 10%, and most preferably from 0.1% to 5%. All types of surfactants may be used in the present invention including nonionic, anionic, cationic, zwitterionic or amphoteric surfactants. It is also possible to use mixtures of such surfactants without departing from the spirit of the present invention.

Highly preferred surfactants for use herein are zwitterionic surfactants. Indeed, they have the ability when added in the acidic compositions of the present invention to maintain the limescale removal performance of the acidic system (i.e. similar limescale removing performance as compared to the same acidic compositions but without any surfactant), while providing excellent grease soap scum cleaning ability to the compositions of the present invention.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

A generic formula for preferred zwitterionic surfactants for use herein (i.e., betaine and/or sulfobetaine) is:

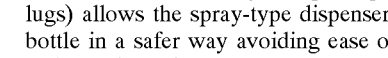

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group, preferably sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—$NR_b$—$(C(R_c)_2)_m$, wherein $R_a$ is an aliphatic or aromatic, saturated or unsaturated, substituted or unsubstituted hydrocarbon chain containing from 8 up to 20 carbon atoms, preferably an alkyl group containing from 8 up to 20 carbon atoms, preferably up to 18, more preferably up to 16, $R_b$ is either a hydrogen a short chain alkyl or substituted alkyl containing from 1 to 4 carbon atoms, preferably a group selected from the group consisting of methyl, ethyl, propyl, hydroxy substituted ethyl or propyl and mixtures thereof, more preferably methyl or hydrogen, $R_c$ is selected from the group consisting of hydrogen and hydroxy groups, and m is from 1 to 4, preferably from 2 to 3, more preferably 3, with no more than one hydroxy group in any $(C(R_c)_2)$ moiety.

Preferred $R_2$ is hydrogen, or an alkyl or substituted alkyl containing from 1to 4 carbon atoms, preferably a group selected from the group consisting of methyl, ethyl, propyl, hydroxy substituted ethyl or propyl and mixtures thereof, more preferably methyl. Preferred $R_3$ is a $C_1$–$C_4$ carboxylic acid group, a C1–C4 sulfonate group, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_4$ is $(CH2)_n$ wherein n is an integer from 1 to 10, preferably from 1 to 6, more preferably is from 1 to 3.

Some common examples of betainelsulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, Ndimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

A further example of betaine is Lauryl-imminodipropionate commercially available from Rhone-Poulenc under the trade name Mirataine H2C-HA ®.

Particularly preferred zwitterionic surfactants for use in the acidic compositions of the present invention are the sulfobetaine surfactants as they deliver optimum limescale removal benefits and soap scum cleaning benefits.

Examples of particularly suitable sulfobetaine surfactants include tallow bis(hydroxyethyl) sulphobetaine, cocoamido propyl hydroxy sulfobetaines which are commercially available from Rhone Poulenc and Witco, under the trade name of Mirataine CBS® and Rewoteric AM CAS 15® respectively.

Further examples of amidobetaines/amidosulfobetaine include cocoamidoethylbetaine, cocoamidopropyl betaine or C10–C14 fatty acylamidopropylene(hydropropylene) sulfobetaine. For example C10–C14 fatty acylamidopropyiene(hydropropylene)sulfobetaine is commercially available from Sherex Company under the trade name "Varion CAS® sulfobetaine".

Suitable amine oxides for use herein are according to the following formula $R_1R_2R_3NO$ wherein each of R1, R2 and R3 is independently a saturated or unsaturated, substituted or unsubstituted, linear or branched alkyl group containing from 1 to 30 carbon atoms, and preferably from 1 to 20 carbon atoms. Particularly preferred amine oxides to be used according to the present invention are amine oxides having the following formula $R_1R_2R_3NO$ wherein R1 is a saturated or unsaturated, substituted or unsubstituted, linear or branched alkyl group containing from 1 to 30 carbon atoms, preferably from 8 to 20 carbon atoms, more preferably from 6 to 16, most preferably from 8 to 14, and wherein R2 and R3 are independently substituted or unsubstituted, linear or branched alkyl groups containing from 1 to 4 carbon atoms, preferably from 1 to 3 carbon atoms, and more preferably are methyl groups, or mixtures thereof.

Suitable amine oxides for use herein are for instance coconut dimethyl amine oxides, C12–C16 dimethyl amine oxides. Said amine oxides may be commercially available from Hoechst, Stephan, AKZO (under the trade name Aromox®) or FINA (under the trade name Radiamox®).

Suitable amines for use herein are according to the following formula RR'R"N wherein R is a saturated or unsaturated, substituted or unsubstituted, linear or branched alkyl groups containing from 1 to 30 carbon atoms, and preferably from 1 to 20 carbon atoms and wherein R' and R" are independently saturated or unsaturated, substituted or unsubstituted, linear or branched alkyl groups containing from 1 to 30 carbon atoms or hydrogen. Particularly preferred amines to be used according to the present invention are amines having the following formula RR'R"N wherein R is a saturated or unsaturated, linear or branched alkyl group containing from 1 to 30 carbon atoms, preferably from 8 to 20 carbon atoms, more preferably from 6 to 16, most preferably from 8 to 14 and wherein R' and R" are independently substituted or unsubstituted, linear or branched alkyl groups containing from 1 to 4 carbon atoms, preferably from 1 to 3 carbon atoms, and more preferably are methyl groups, or mixtures thereof.

Suitable amines for use herein are for instance C12 dimethyl amine, coconut dimethyl amine, C12–C16 dimethyl amine. Said amines may be commercially available from Hoechst under the trade name Genamin®, AKZO under the trade name Aromox® or Fina under the trade name Radiamine®.

Suitable quaternary ammonium surfactants for use herein are according to the formula $R_1R_2R_3R_4N^+X^-$, wherein X is a counteranion such as halogen, methyl sulphate, methyl sulphonate, or hydroxide, $R_1$ is a saturated or unsaturated, substituted or unsubstituted, linear or branched alkyl group containing from 1 to 30 carbon atoms, preferably from 12 to 20, more preferably from 8 to 20 and $R_2$, $R_3$ and $R_4$ are independently hydrogen, or saturated or unsaturated, substituted or unsubstituted, linear or branched alkyl groups containing from 1 to 4 carbon atoms, preferably from 1 to 3 and more preferably methyl. In highly preferred quaternary ammonium surfactants herein $R_1$ is a $C_{10}$–$C_{18}$ hydrocarbon chain, most preferably $C_{12}$, $C_{14}$, or $C_{16}$, and $R_2$, $R_3$ and $R_4$ are all three methyl, and X is halogen, preferably bromide or chloride, most preferably bromide.

Examples of quaternary ammonium surfactants are myristyl trimethylammonium methyl sulphate, cetyl trimethylammonium methyl sulphate, lauryl trimethyl ammonium bromide, stearyl trimethyl ammonium bromide (STAB), cetyl trimethyl ammonium bromide (CTAB) and myristyl trimethyl ammonium bromide (MTAB). Highly preferred herein are lauryl trimethyl ammonium salts. Such trimethyl quaternary ammonium surfactants may be commercially available from Hoechst, or from Albright & Wilson under the trade name Empigen CM®.

In a preferred embodiment, the surfactant used in the acidic compositions of the present invention is a surfactant system comprising a zwitterionic surfactant with a second surfactant, e.g. an amine oxide and/or amine and/or a quaternary ammonium surfactant as described herein at a weight ratio of the zwitterionic surfactant to the second surfactant of at least 1:1, preferably at least 2:1. This surfactant system provides to the acidic compositions according to the present invention both optimum limescale removing performance (i.e, comparable to the limescale removing performance of the same compositions without any surfactant) as well as optimum greasy soap scum cleaning performance.

Suitable nonionic surfactants for use herein are alkoxylated alcohol nonionic surfactants which can be readily made by condensation processes which are well-known in the art. However, a great variety of such alkoxylated alcohols, especially ethoxylated and/or propoxylated alcohols is also conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from 2 to 24 carbon atoms, e is ethylene oxide and p is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol® or from BASF under the trade name Lutensol®D. These nonionics are preferred because they have been found to allow the formulation of a stable product without requiring the addition of stabilisers or hydrotopes.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_{12}$–$C_{18}$ alkyl group and more preferably a $C_{14}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "secondary C6–C20 alkyl or C6–C20 alkyl aryl sulphonates", it is meant herein that in the formula as defined above, the SO3M or aryl-SO3M group is linked to a carbon atom of the alkyl chain being placed between two other carbons of the said alkyl chain (secondary carbon atom).

An example of a C14–C16 alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 15 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quatemary ammonium cations derived from alkylamines such as ethylamine, diethylamine, triethylamine, and mixtures thereof, and the like).

Suitable alkyl alkoxylated sulphate surfactants for use herein are according to the formula $RO(A)_mSO_3M$ wherein R is an unsubstituted $C_6$–$C_{20}$ alkyl or hydroxyalkyl group having a $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Suitable $C_6$–$C_{20}$ alkyl alkoxylated linear or branched diphenyl oxide disulphonate surfactants for use herein are according to the following formula:

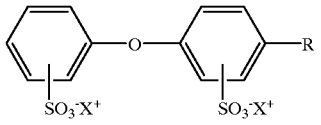

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium potassium, lithium, calcium, magnesium and the like). Particularly suitable $C_6$–$C_{20}$ alkyl alkoxylated linear or branched diphenyl oxide disulphonate surfactants to be used herein are the C12 branched di phenyl oxide disulphonic acid and C16 linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Preferred anionic surfactants herein include the primary and secondary $C_6$–$C_{20}$ alkyl suplonates and the primary and secondary $C_6$–$C_{20}$ alkyl aryl sulphonates or a mixture thereof.

Dyes

The liquid compositions according to the present invention may be coloured. Accordingly, they may comprise a dye or a mixture thereof. Suitable dyes for use herein are acid-stable dyes. By "acid-stable", it is meant herein a compound which is chemically and physically stable in the acidic environment of the compositions herein. Suitable dyes for use herein include α or β metal phthalocyanines and/or trimethyl methane dyes.

The α or β metal phthalocyanine dyes suitable to be used in the compositions of the present invention are light-fast organic pigments with four isoindole groups, $(C_6H_4)C_2N$, linked by four nitrogen atoms to form a conjugated chain. Their general structure is the following:

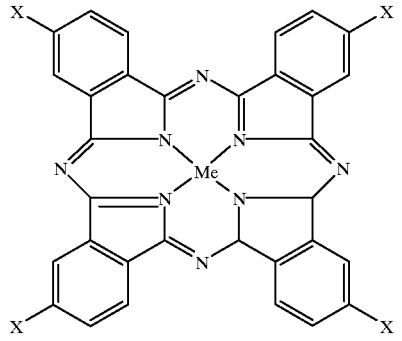

where the substituent X may be one of the following groups: H, Cl, $HSO_3$, COO—M+, Br, $NO_2$, $OCH_3$ or a $C_1$ to $C_{10}$ alkyl group and where Me is copper, chromium, vanadium, magnesium, nickel, platinum, aluminium, cobalt, lead, barium or zinc. Preferred α or β metal phthalocyanine dyes to be used herein are α or β copper phthalocyanine dyes.

Examples of such a copper phthalocyanine dyes to be used herein are copper phthalocyanine (X=H, blue colour) commercially available under the name UNISPERSE Blue B-E® from Ciba-Geigy, or Cosmenyl blue A2R® from Hoechst, or Pigmasol blue 6900® from BASF, or chlorinated copper phthalocyanine (X=Cl, green colour) commercially available under the name Pigmasol Green 8730® from BASF.

Examples of trimethyl methane dyes are commercially available from Hoescht under the name VitasynoR or from BASF under the name Acid Blue®.

Also suitable dyes for use herein are polymeric liquid colours such as the liquid polymer-blue supplied by Milliken Company under the name Liquitint® Blue 65, Liquitint® Patent Blue and Liquitint® Bright Blue.

Typically, the compositions of the present invention may comprise up to 0.2% by weight of the total composition of a dye or a mixture thereof, preferably from 0.0001% to 0.015% and more preferably from 0.001% to 0.010%.

Radical Scavengers:

The compositions of the present invention may comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers when used, are typically present herein in amounts up to 10% by weight of the total composition and preferably from 0.001% to 0.5% by weight.

The presence of radical scavengers may contribute to the chemical stability of the acidic compositions of the present invention.

Process for Treating Surfaces:

The compositions according to the present invention are particularly suitable for treating hard-surfaces soiled by limescale-containing stains. By "limescale-containing stains" it is meant herein any pure limescale stains, i.e., any stains composed essentially of mineral deposits as well as limescale-containing stains typically found, for example, in a kitchen or in a bathroom, i.e., stains which contain not only mineral deposits like calcium and/or magnesium carbonate but also soap scum (e.g., calcium stearate) and other grease (e.g. body grease). Actually, the compositions of the present invention exhibit excellent limescale removing performance when used to treat any types of surfaces soiled by limescale-containing stains comprising not only pure limescale deposits but also at least 10% by weight of the total stain of organic deposits like soap scum and grease, preferably more than 30%. Such surfaces can be found in bathrooms, kitchens, but also in appliances including large appliances such as automatic dish washers and/or washing machines.

Accordingly, the present invention encompasses a process of treating hard-surfaces soiled by limescale-containing stains wherein an aqueous acidic liquid composition according to the present invention is applied onto said surfaces from a spray-type dispenser, then left to act onto said surfaces and then removed by rinsing.

The expression "treating" includes removing limescale deposits while being safe to the surfaces treated and optionally cleaning greasy soap scum stains especially when surfactants are present.

Limescale Removal Performance Test Method:

The limescale removal capacity of a composition according to the present invention may be evaluated spraying the composition on encrusted ceramic tiles prepared using the auto dish washing machine. Black glazed ceramic tiles (typically 20 cm×20 cm) are poured into the auto dish washing machine and treated with 7 complete washing cycles. Each cycle is performed using 15 g of Sodium Carbonate (instead of the detergent) at temperature of 80° C. and rinsing water at 70° C. The resulting tiles will have an homogeneous thin layer of limescale (calcium carbonate precipitated during the washing cycle). Then, two vertical encrusted tiles are sprayed three times (equivalent at about 5 g of product) with a composition according to the present invention and a reference composition, e.g. the same composition but without the polymers as described herein. The compositions are sprayed using the T8900® foamer spray dispenser (having orifice diameter modified at 0.030" width and spinner channels 0.0425" width). Surfaces are rinsed after 30 seconds with water (until all residues of product are removed) and then left to dry. After the surfaces treated with the compositions according to the present invention and those treated with the reference composition get dried, they are compared side by side and evaluated by visual grading to evaluate limescale removal difference. Performance evaluation may be generally done by applying the Panel Score Unit (PSU).

Greasy Soap Scum Cleaning Performance Test Method:

In this test method enamel white tiles (typically 24 cm*4 cm) are covered with typical greasy soap scum soils mainly based on calcium stearate and artificial body soils commercially available (e.g. 0.3 grams with a sprayer). The soiled tiles are then dried in an oven at a temperature of 140° C. for 30 minutes and then age d overnight at room temperature (around 15° C.–20° C.). Then the soiled tiles are cleaned using 3 ml of the liquid acidic composition of the present invention poured directly on a Spontex® sponge. The ability of the composition to remove greasy soap scum is measured through the number of strokes needed to perfectly clean the surface. The lower the number of strokes, the higher the greasy soap scum cleaning ability of the composition.

Shine Test Method:

Obtaining a good shine end result results from a good spreading of a liquid composition over the surface when the surface is treated therewith and from the reduced formati on of watermarks and reduced precipitation of poorly water soluble salts when water evaporates. The ability of a composition to provide "shine" to the surface refers to the compositi ongs ability to leave no watermarks after evaporation of water. This can be evaluated by human visual grading.

In a suitable test method two rectangular areas (10 cm×4 cm) of a sink (made of either stainless steel or ceramic) are sprayed twice (equivalent at about 3 grams of product) with a composition according to the present invention and a reference composition, e.g. the same composition but without the polymers as described herein. Each surface is then wiped (10 strokes) by using a Spontex® sponge. Then each treated surface is rinsed with 200 grams of tap water and left to dry. Items are observed during the drying phase in a way to evaluate water spreading/slipping on the treated surface. After the surfaces treated with the compositions according to the present invention and those treated with the reference composition get dried, they are compared side by side and evaluated by visual grading to evaluate shine difference. Evaluation may be generally done by applying the Panel Score Unit (PSU). Shine result is expressed reporting whether the effect of water spreading/slipping is present and the final PSU evaluation.

In a long lasting shine test method, the test method as mentioned above may be carried out, but the rinsing and drying cycle are repeated several times. Each times after both the surfaces get dried they are compared side by side and evaluated by visual grading to see shine difference. Evaluation is generally done by applying the Panel Score Unit (PSU).

The present invention is further illustrated by the following examples.

EXAMPLES

These compositions were made comprising the listed ingredients in the listed proportions (weight %).

| Ingredients: (% by weight) | I | II | III | IV | V | VI |
|---|---|---|---|---|---|---|
| Maleic acid | 10 | 10 | 10 | 10 | 6 | 10 |
| Sulphamic acid | 2 | 2 | — | — | 2 | 2 |
| Citric acid | — | — | 2 | — | — | 2 |
| Dobanol ® 91-8 | 2.2 | — | — | 2.0 | 2.2 | |
| Mirataine CBS ® | — | 2 | 2 | — | — | 2.0 |
| Aromox ® C12–C14 | — | — | — | — | — | 0.5 |
| Kelzan T ® | 0.35 | 0.35 | 0.30 | 0.40 | 0.35 | 0.30 |
| PVP ® K60 | 0.05 | 0.05 | 0.05 | 0.03 | 0.05 | 0.04 |
| Waters & Minors | | | up to 100 | | | |

| Ingredients: (% by weight) | VII | VIII | IX | X | XI | XII |
|---|---|---|---|---|---|---|
| Maleic acid | 8 | 10 | 12 | 10 | 12 | 12 |
| Sulphamic acid | 2 | 2 | 2 | — | — | — |
| Citric acid | — | 1 | — | 2 | 2 | — |
| Dobanol 91-10 ® | — | 3 | — | 1 | 4 | — |
| Rewoteric AM CAS 15 ® | 2 | — | 2 | 1 | — | 2.2 |
| Rhodopol ® T | 0.30 | 0.30 | 0.32 | 0.35 | 0.35 | 0.25 |

-continued

| | | | | | | |
|---|---|---|---|---|---|---|
| Luviskol ® K30 | 0.03 | 0.05 | 0.05 | 0.06 | 0.05 | 0.05 |
| Waters & Minors | | | up to 100 | | | |

| Ingredients: (% by weight) | XIII | XIV | XV | XVI | XVII | XVIII |
|---|---|---|---|---|---|---|
| Maleic acid | — | 10 | 12 | — | 10 | 12 |
| Sulphamic acid | 2 | 2 | — | 2 | — | 2 |
| Citric acid | — | — | — | 6 | 2 | — |
| Lutensol TO 6 ® | — | 0.4 | 2 | — | 0.5 | 1.5 |
| Empigen BB/L ® | 1 | 1 | — | 2 | — | 1 |
| Rheozan ® | 1 | 0.5 | 0.8 | 0.3 | 0.25 | 0.4 |
| BHT | 0.05 | 0.05 | 0.03 | 0.05 | 0.05 | 0.05 |
| Gafquat 755 ® | 0.05 | 0.01 | 0.05 | 0.1 | 0.2 | 0.05 |
| Waters & Minors | | | up to 100 | | | |

Mirataine CBS® and Rewoteric AM CAS® 15 are cocoamidopropyl hydroxy sulphobetaines supplied respectively by Rhone-Poulenc and Witco.

Dobanol® 91-8 and Lutensol TO 6® are ethoxylated alcohol nonionic surfactants supplied respectively by Shell (and having a alkyl chain length of C9–C11 and a degree of ethoxylation of 8) and BASF (and having a alkyl chain length of C13 and a degree of ethoxylation of 3).

Aromox® C12–C14 is an amineoxide having an alkyl chain length of C12–C14 supplied by AKZO.

Kelzan T® and Rhodopol T® are Xanthan gum supplied respectively by Kelco and Rhone Poulenc.

Rheozan® is a succinoglycan gum supplied by Rhone Poulenc. PVP K60® and Luviskol K30® are polyvinylpyrrolidone homopolymer supplied respectively by ISP and BASF.

Gafquat 755® is a vinylpyrrolidone/dialkylaminoalkyl methacrylate copolymers supplied by ISP.

BHT is tert-butyl hydroxy toluene.

The above compositions were packaged in a spray-type dispenser, for example the model T8900® (Continental Spray International) modified with orifice diameter 0.030" (0.030 inches) width and spinner channels 0.0425" (0.0425 inches) width. They all exhibit excellent immediate and long lasting shine benefits on the surface treated while providing excellent limescale removal performance. Also the redeposition of limescale deposits on a hard-surface that has been first treated with one of the compositions exemplified above, is reduced or even prevented, when said surface comes again in contact with water, upon prolonged period of time, this both when used neat or in diluted form.

What is claimed is:

1. A liquid acidic composition suitable for removing limescale-containing stains from a hard-surface, wherein said composition has a pH less than 4, comprising from 0.1% to 70% by weight of an acid, from 0.001% to 20% by weight of the total composition of a polysaccharide polymer selected from the group consisting of a substituted cellulose material, succinoglycan, guar gum, locust bean gum, tragacanth gum, and mixtures thereof and from 0.001% to 20% by weight of the total composition of a vinylpyrrolidone homopolymer or copolymer wherein said vinylpyrolidone copolymer is a copolymer of N-vinylpyrrolifone and an alkylenically unsaturated monomer selected from the group consisting of maleic acid, chloromaleic acid, fumaric acid, itaconic acid, citraconic acid, phenylmaleic acid, aconitic acid, acrylic acid, N-vinylimidazole, vinyl acetate and anhydrides thereof, styrene, sulphonated styrene, alpha-methyl styrene, vinyl styrene, t-butyl styrene and mixtures thereof; or said vinylpyrrolidone copolymer is a quaternized or unquaternized vinylpyrrolidone/dialkylaiinoalkyl acrylate or methacrylate copolymer having the following formula:

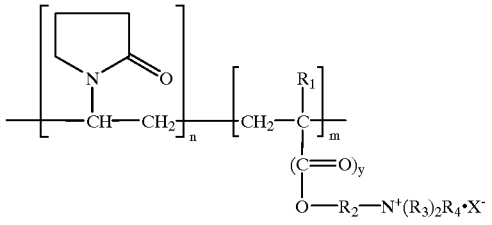

in which n is between about 20 and about 99; m is between about 1 and about 80; R1 represents H or $CH_3$; y denotes 0 or 1; $R_2$ is —$CH_2$—CHOH—$CH_2$— or $C_xH_{2x}$, in which x is from 2 to 18; $R_3$ represents a lower alkyl group of from about 1 to about 4 carbon atoms or

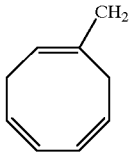

R4 denotes a lower alkyl group of from about 1 to about 4 carbon atoms; X— is chosen from the group consisting of Cl, Br, I, ½$SO_4$, $HSO_4$, $CH_3SO_3$; or mixtures of said hompolymer and copolymer, said composition being packaged in a spray dispenser.

2. A composition according to claim 1 wherein said acid is an organic or inorganic acid or a mixture thereof.

3. A composition according to claim 1 wherein said acid is maleic acid alone or together with a second acid which has its first pKa not exceeding 5.

4. A composition according to claim 3 wherein said second acid is sulphamic acid, alkylsulfonic acid, arylsulfonic acid, citric acid, nitric acid, sulphuric acid, phosphoric acid, hydrochloric acid or a mixture thereof.

5. A composition according to claim 4 wherein said composition comprises from about 0.1% to about 45% by weight of the total composition of maleic acid, and optionally from about 0.1% to about 25% by weight of the total composition of said second acid.

6. A composition according to claim 5 wherein said composition comprises from about 1% to about 25% by weight of the total composition of maleic acid, and optionally from about 0.1% to about 20% by weight of the total composition of said second acid.

7. A composition according to claim 5 wherein said composition comprises from about 6% to about 20% by weight of the total composition of maleic acid, and optionally from 0.1% to 10% by weight of the total composition of said second acid.

8. A composition according to claim 1 wherein said vinylpyrrolidone homopolymer is a homopolymer of N-vinylpyrrolidone having the following repeating monomer:

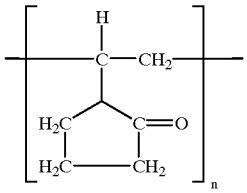

wherein n is an integer of from about 10 to about 1,000,000.

9. A composition according to claim 1 which comprises from about 0.01% to about 5% by weight of the total composition of a vinylpyrrolidone homopolymer or copolymer or mixture thereof.

10. A composition according to claim 9 which comprises from about 0.01% to about 3% by weight of the total composition of a vinylpyrrolidone homopolymer or copolymer or mixture thereof.

11. A composition according to claim 9 which comprises from about 0.01% to about 1% by weight of the total composition of a vinylpyrrolidone homopolymer or copolymer or mixture thereof.

12. A composition according to claim 1 which comprises from about 0.01% to about 10% by weight of the total composition of a polysaccharide polymer.

13. A composition according to claim 12 which comprises from about 0.01% to about 5% by weight of the total composition of a polysaccharide polymer.

14. A composition according to claim 12 which comprises from about 0.01% to about 2% by weight of the total composition of a polysaccharide polymer.

15. A composition according to claim 1 which comprises a surfactant or a mixture thereof up to a level of about 40% by weight of the total composition.

16. A composition according to claim 1 wherein said composition has a pH below 7.

17. A composition according to claim 1 wherein said composition has a pH of from about 0.1 to about 2.5.

18. A composition according to claim 1 wherein said composition has a pH of from about 0.1 to about 2.

19. A composition according to claim 1 wherein said spray dispenser is a foam trigger spray dispenser.

20. A process of treating a hard-surface soiled by limescale-containing stains, wherein an acidic liquid composition according to claim 1 is applied onto said surface from a spray dispenser, then left to act onto said surfaces, and then removed by rinsing.

* * * * *